US007327550B2

(12) United States Patent
Meyer et al.

(10) Patent No.: US 7,327,550 B2
(45) Date of Patent: Feb. 5, 2008

(54) FREQUENCY DIVERSITY REMOTE CONTROLLED INITIATION SYSTEM

(75) Inventors: Erich Nicol Meyer, North West Province (ZA); Charles Michael Lownds, Edina, MN (US)

(73) Assignee: Orica Explosives Technology Pty. Ltd., Melbourne (AU)

( * ) Notice: Subject to any disclaimer, the term of this patent is extended or adjusted under 35 U.S.C. 154(b) by 383 days.

(21) Appl. No.: 10/489,772

(22) PCT Filed: Oct. 1, 2002

(86) PCT No.: PCT/ZA02/00151

§ 371 (c)(1),
(2), (4) Date: Aug. 30, 2004

(87) PCT Pub. No.: WO03/029748

PCT Pub. Date: Apr. 10, 2003

(65) Prior Publication Data

US 2005/0030695 A1 Feb. 10, 2005

(30) Foreign Application Priority Data

Oct. 2, 2001 (ZA) ..... 01/8080

(51) Int. Cl.
*F23Q 7/00* (2006.01)

(52) U.S. Cl. ..... 361/248; 361/251

(58) Field of Classification Search ..... 361/248–251; 102/200, 206
See application file for complete search history.

(56) References Cited

U.S. PATENT DOCUMENTS

| | | | | | |
|---|---|---|---|---|---|
| 3,780,654 | A | * | 12/1973 | Shimizu et al. | 102/312 |
| 4,825,765 | A | * | 5/1989 | Ochi et al. | 102/206 |
| 4,895,075 | A | * | 1/1990 | Munzel | 102/214 |
| 5,159,149 | A | * | 10/1992 | Marsden | 102/217 |

FOREIGN PATENT DOCUMENTS

| | | |
|---|---|---|
| EP | 0 616 190 A | 9/1994 |
| WO | 91/07637 A | 5/1991 |
| WO | 00/02005 A | 1/2000 |

* cited by examiner

*Primary Examiner*—Michael Sherry
*Assistant Examiner*—Danny Nguyen
(74) *Attorney, Agent, or Firm*—Nixon & Vanderhye P.C.

(57) ABSTRACT

A blasting system includes a wireless link between a blast controller and a plurality of electronic detonators. Each detonator includes a respective electronic initiator and an explosive charge. Charge storage devices of the initiators are chargeable by a carrier of a first signal having a first frequency (f1) in the order of 400 MHz-500 MHz and which is broadcasted by the blast controller. Each initiator further includes logic circuitry driven by a clock signal which is derived from the first signal and having a clock frequency of about 4 kHz, which is substantially less than the first frequency.

18 Claims, 6 Drawing Sheets

FREQUENCY DIVERSITY REMOTE CONTROLLED INITIATION SYSTEM

This application is the U.S. national phase of international application PCT/ZA02/00151, filed in English on 01 Oct. 2002, which designated the U.S. PCT/ZA02/00151 claims priority to ZA Application No. 01/8080 filed 02 Oct. 2001. The entire contents of these applications are incorporated herein by reference.

TECHNICAL FIELD

THIS invention relates to electric and electronic blasting systems for mining applications, detonators and initiators therefor.

SUMMARY OF THE INVENTION

According to the invention there is provided a blasting system comprising a wireless link for broadcasting towards a plurality of detonators a first signal comprising a first frequency and wherein each detonator comprises logic circuitry driven by a second signal having a second frequency which is substantially lower than the first frequency.

The second signal may be a clock signal which may be derived from the first signal.

The first signal may comprise a carrier signal having the first frequency. The first frequency may fall in the range 200 MHz to 100 GHz. The first frequency is preferably about 400 MHz to 500 MHz. The first signal may further comprise a data signal modulated on the carrier signal. Any suitable modulation technique such as amplitude modulation, frequency modulation, pulse-width modulation, pulse-code modulation etc may be utilized.

Each detonator may comprise a charge storage device which is charged while the detonators are energized utilizing the first signal. The charge storage device may comprise a capacitor. In other embodiments the charge storage devices may be charged via a physical conductive link from a common source of charge, such as a battery.

The clock signal may be derived by dividing the frequency of the first signal down by divider means. The clock frequency may be between 1 kHz and 15 kHz, typically between 4 kHz to 5 kHz.

The divider means may be common to at least some of the detonators and the divider means may be connected to a receiver forming part of the wireless link as well as to said at least some of the detonators by a physical conductive link.

In other embodiments the divider means may comprise a respective divider circuit for each detonator.

Each detonator may comprise an electric or electronic initiator comprising a high frequency part and a low frequency part, the high frequency part comprising an RF receiver stage, said charge storage device connected to the RF receiver stage and said respective divider circuit.

The low frequency part may comprise a phase-locked loop and local oscillator connected to an output of said respective divider circuit and providing the clock signal to the logic circuitry forming part of the low frequency part.

An input of the logic circuitry may be connected via a data line to an output of a level detection circuit in the high frequency part. The logic circuitry may be programmable by delay time data in the data signal to operate a switch of the initiator to cause charge on the charge storage device to be dumped into a fuse of the detonator, a delay time, which is associated with the delay time data, after a fire signal.

The divider means may divide the first frequency by about five orders, so that the frequency of the clock signal is in the order of 1 kHz-15 kHz.

The high and low frequency parts may be integrated on a single chip.

In other embodiments, the high frequency and low frequency parts may be split into separate first and second parts respectively and the output of the divider circuit in the first part may be connected by a physical conductive link to the second part. The first or high frequency part may be located towards a mouth or collar of a blast hole wherein the detonator is located, and the second part may be located towards a bottom region of the hole.

The wireless link may be provided between a remote blast controller comprising an RF transmitter and an antenna located in close proximity to the blast controller on the one hand and the plurality of detonators on the other hand.

In other embodiments the wireless link may be provided between said plurality of detonators and an RF transmitter located in closer proximity to the detonators. The antenna may be a line source, for example the antenna may comprise a cable running the length of a long relatively narrow blast site.

The RF transmitter may be connected to the blast controller by a physical conductive link. Alternatively, a second wireless link may be provided between the RF transmitter and the remote blast controller.

Also included within the scope of the present invention is a method of operating a blasting system comprising the steps of:

- broadcasting a first high frequency RF signal to each of a plurality of detonators; and
- utilizing a second low frequency signal for driving logic circuitry forming part of each detonator.

The second signal is preferably derived from the first signal by dividing down the frequency of the first signal.

Yet further included within the scope of the present invention is an initiator for a detonator, the initiator comprising:

- a high frequency part comprising a radio frequency receiver stage for receiving a first high frequency signal; and
- a low frequency part comprising logic circuitry which is driven by a second signal having a frequency which is lower than the frequency of the first signal.

BRIEF DESCRIPTION OF THE ACCOMPANYING DIAGRAMS

The invention will now further be described, by way of example only, with reference to the accompanying diagrams wherein.

DESCRIPTION OF PREFERRED EMBODIMENTS OF THE INVENTION

Figure 1:
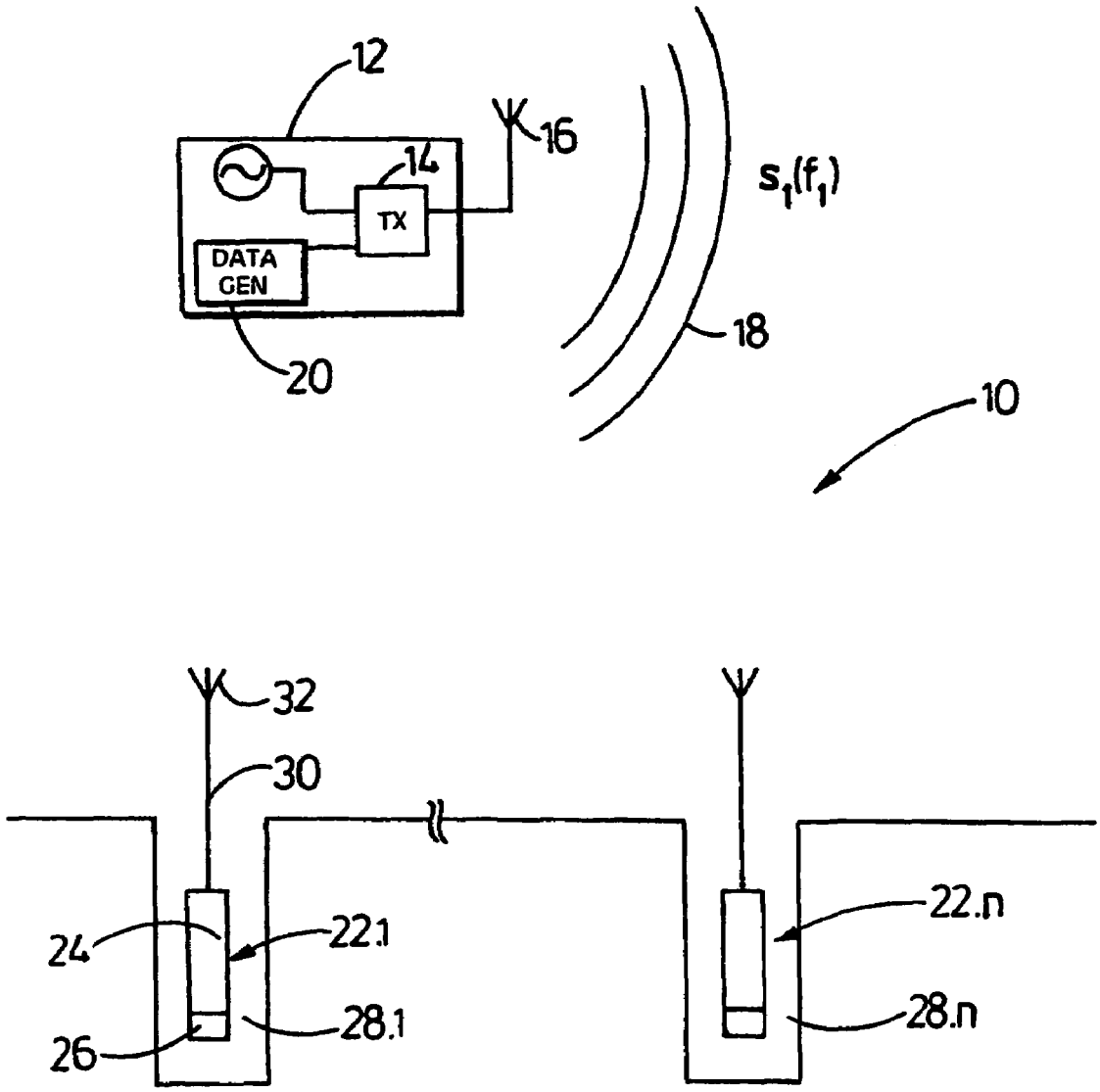
FIG. 1 is a basic block diagram of a first embodiment of an electronic blasting system according to the invention.

A first embodiment of a blasting system according to the invention is generally designated by the reference numeral 10 in FIG. 1.

The system comprises a blast controller 12 comprising a radio frequency transmitter 14 connected to an antenna 16. The transmitter, in use, broadcasts a first signal comprising digital data modulated on a carrier 18 having a first high frequency $f_1$. The digital data is generated by a data generator 20 and intended for communications with and more particularly to program a plurality of electronic detonators forming part of the system.

The system further comprises a plurality of similar electronic detonators 22.1 to 22.n. Since the detonators are similar in configuration, only detonator 22.1 will be described in more detail hereinafter. The detonator 22.1 comprises an electronic initiator 24 and an explosive charge 26. The detonator 22.1 is located in one hole 28.1 of a plurality of spaced blast holes 28.1 to 28.n. The initiator 24 is connected via a lead conductor 30 to an antenna 32.

Figure 2:
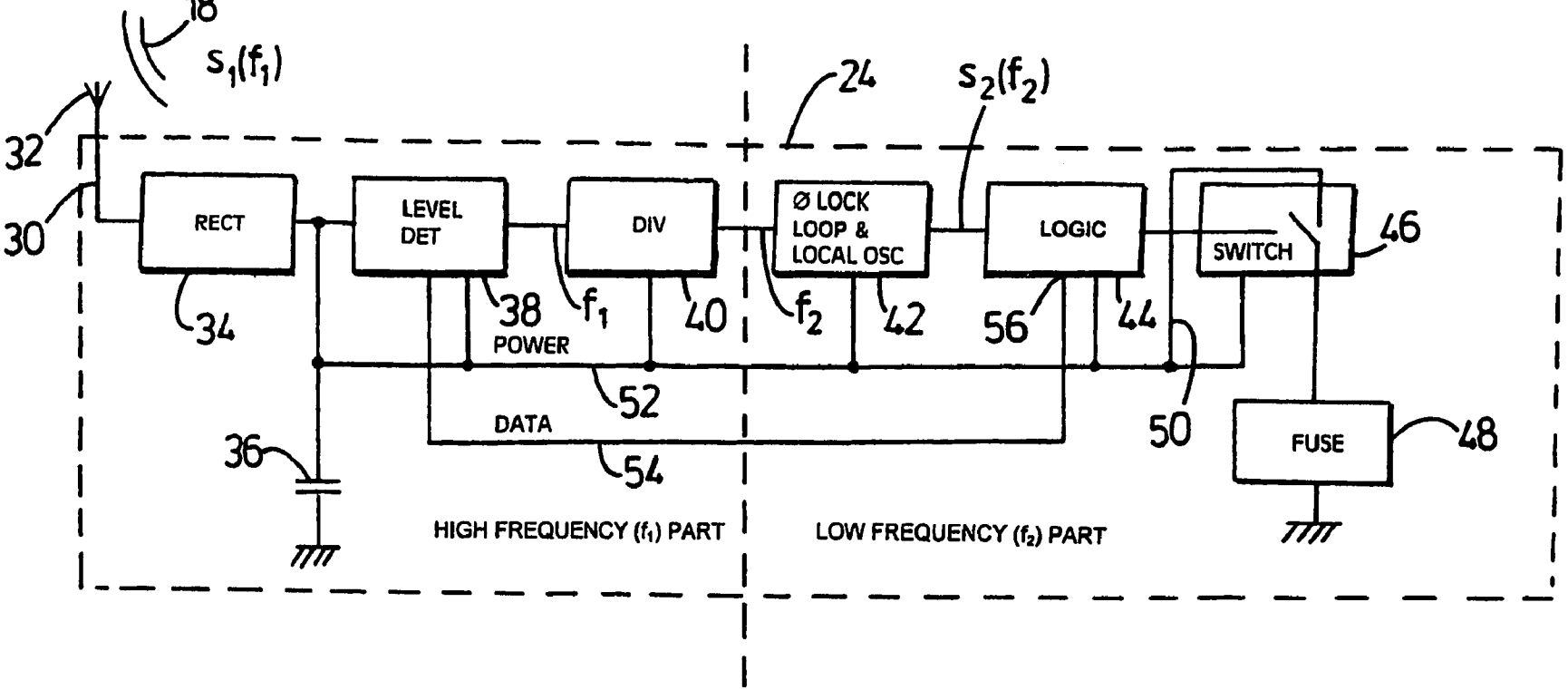
FIG. 2 is a block diagram of an electronic initiator according to the invention and forming part of a detonator of the system in FIG. 1.

In FIG. 2, there is shown a more detailed block diagram of the initiator 24. Antenna 32 is connected via lead conductor 30 to a radio frequency (RF) receiver stage comprising a rectifier 34. An output of the rectifier 34 is connected to a charge storage device in the form of a capacitor 36, to energize or charge the capacitor with energy in the first signal. The output is also connected to level detection circuit 38. The level detection circuit is connected to a divider circuit 40 for dividing down the high frequency carrier 18 of frequency $f_1$ to a signal having a lower frequency $f_2$. The signal with lower frequency $f_2$ is used to drive a phase-locked loop circuit and local oscillator 42. A resulting low frequency output signal $s_2$ ($f_2$) of the local oscillator is used as clock signal to drive logic circuitry 44. The logic circuitry 44 drives a switch circuit 46 to connect a fuse 48 to the capacitor 36 via power line 50, after a pre-programmed delay time associated with the detonator. The delay time is typically programmed into the logic circuitry 44 by delay time data modulated at a suitable rate on the aforementioned carrier signal and utilizing a unique pre-programmed address of the device. The various circuits 34 to 46 may be integrated on a single chip. These circuits derive electrical power from capacitor 36, via power line 52. In some embodiments the carrier and data may be divided down and in other embodiments only the carrier is divided down.

An output of level detection circuit 38 is connected via data line 54 to a data input 56 of logic circuitry 44. A comparator in logic circuitry 44 recovers the digital data modulated on the carrier 18 and received via the antenna in known manner. As stated hereinbefore, an example of the digital data is data relating to the aforementioned delay time and which data is utilized in known manner by the logic circuitry to cause the switch to connect the capacitor 36 to the fuse 48 at the end of the relevant delay time, following a common "fire" signal, for example.

The frequency of the carrier may be between 200 MHz and 100 GHz, typically 400 MHz. A divisor of the divider 40 is typically equal to $10^5$, so that the frequency $f_2$ is in the order of 4 kHz. The frequency $f_2$ may fall in the range 1 kHz to 15 kHz. The data may be modulated on the carrier at a rate in the order of 100 MHz.

Hence, in use, the high frequency $f_1$ of the carrier is used to charge capacitor 36, while the signal $s_2$ having a low frequency $f_2$ is used as clock signal for the logic circuitry 44. The logic circuitry when operating on a lower frequency $f_2$ is more power efficient than with a higher frequency $f_1$.

Figure 3:
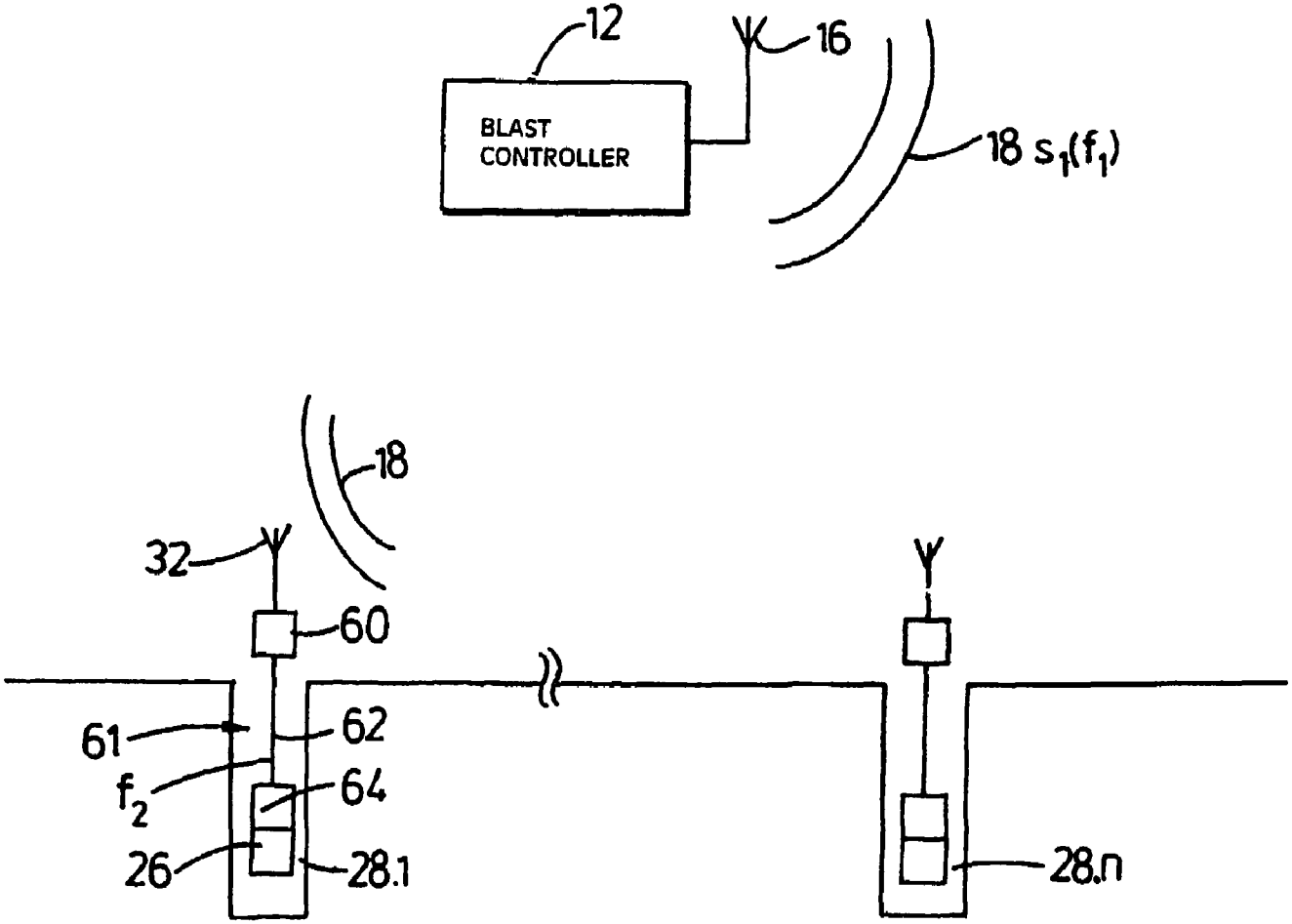
FIG. 3 is a basic block diagram of a second embodiment of the system according to the invention.

In FIG. 3, there is shown a second embodiment of the system. The controller 12 broadcasts the signal having carrier frequency $f_1$ to a high frequency part 60 of a split initiator 61. The high frequency part 60 comprises a divider as hereinbefore described and a low frequency output which is connected via a conductive physical link in the form of normal, low cost wires 62 to an input of a low frequency part 64 of the initiator including at least the logic circuitry 44, switch and fuse. The high frequency part may in use be located in a mouth or collar region of the blast hole and the low frequency part adjacent the charge 26 towards a bottom region of the hole.

Figure 4:
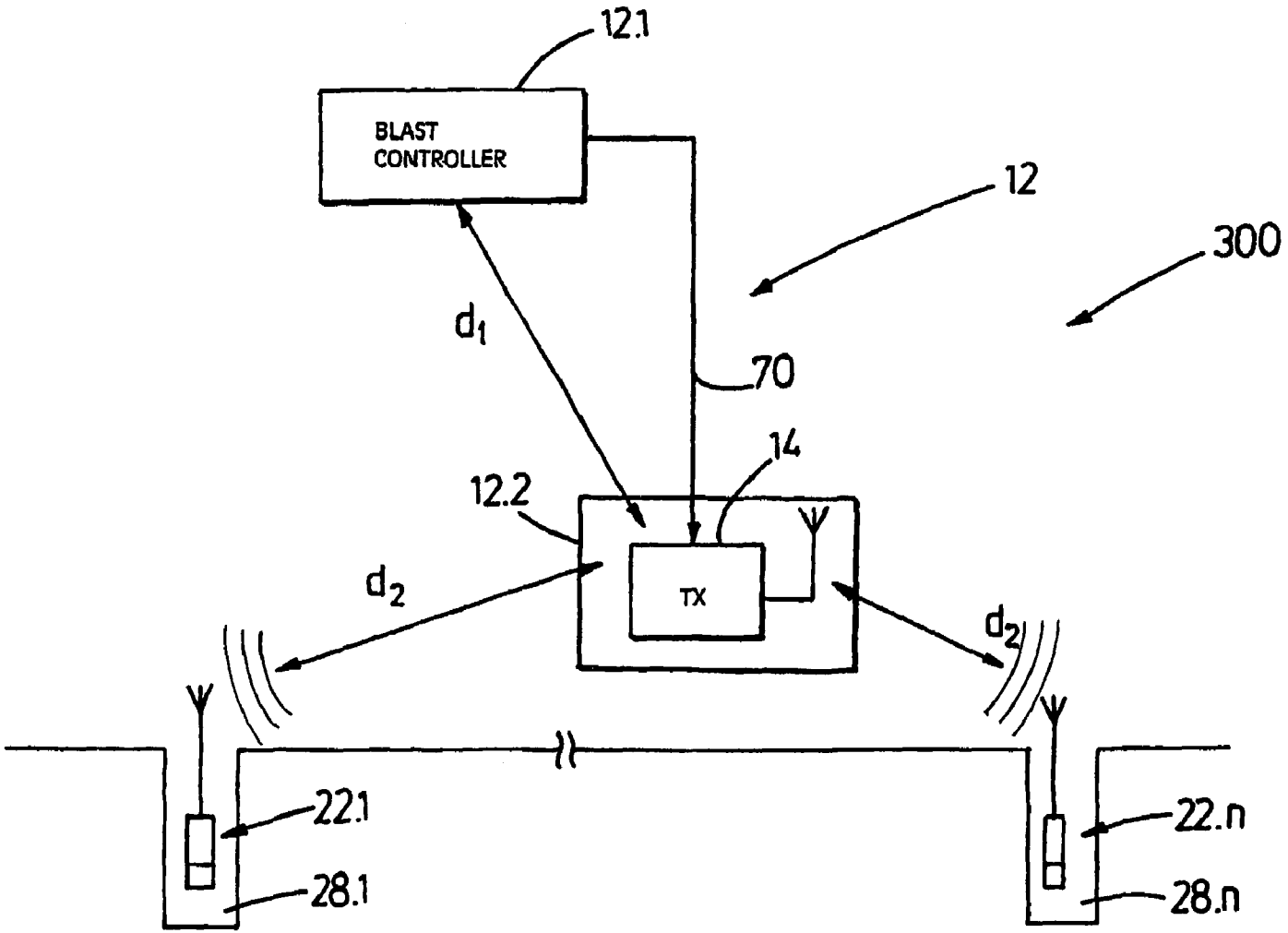
FIG. 4 is a basic block diagram of a third embodiment of the system according to the invention.

In the third embodiment 300 of the system shown in FIG. 4, the blast controller 12 is of split configuration. The data generator is housed in a first part 12.1 and the transmitter 14 forms part of a separate second part 12.2 which is connected via an extension cable 70 to the first part. The first and second parts are spaced a distance $d_1$ of typically between 200 m and 3000 m from one another. The second part 12.2 is spaced a distance $d_2$ of typically in the order of 50 m from each of the detonators 22.1 to 22.n in respective blast holes 28.1 to 28.n.

Figure 5:
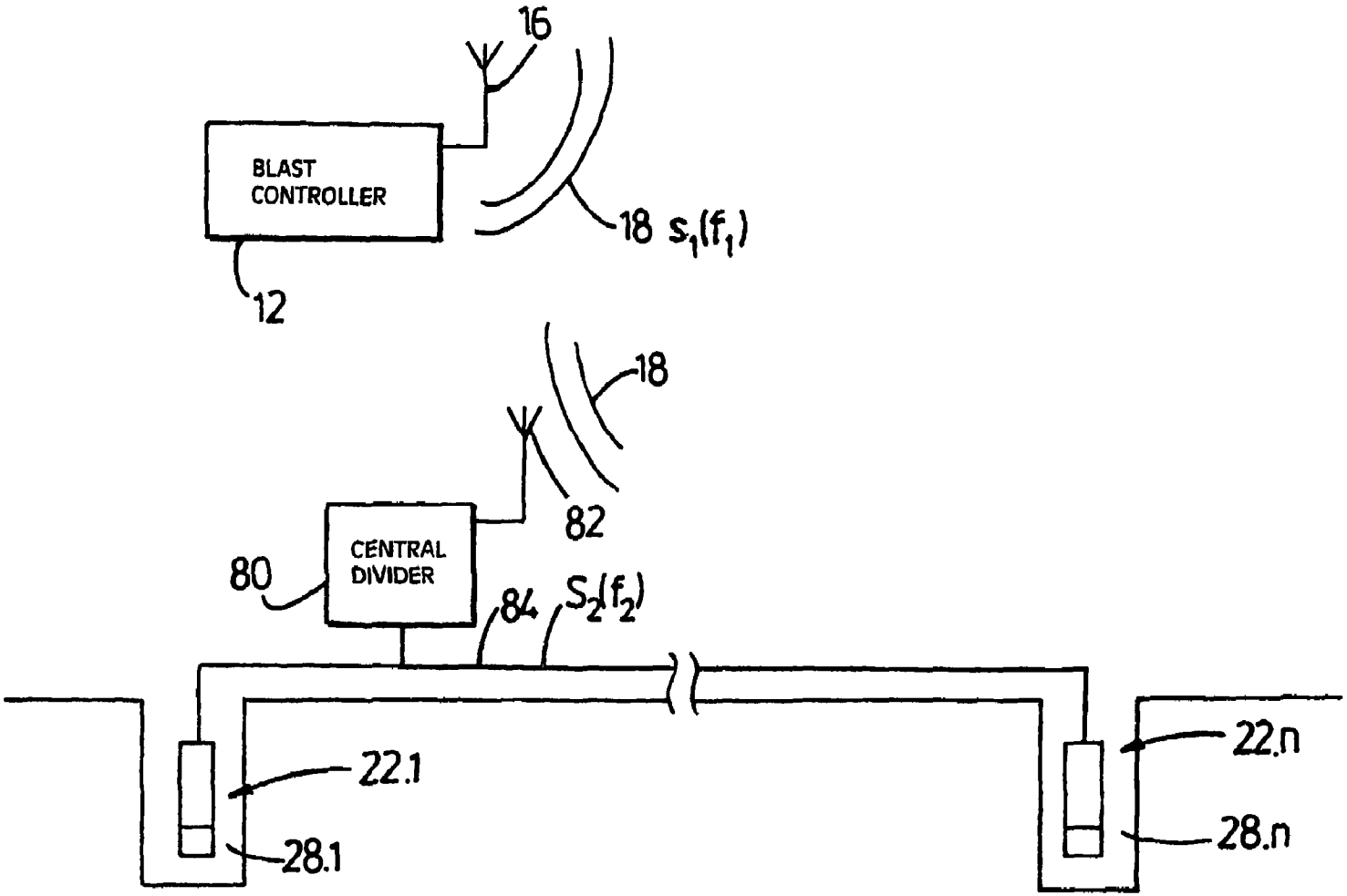
FIG. 5 is a basic block diagram of a fourth embodiment of the system according to the invention.

In FIG. 5, there is shown a blast controller 12 transmitting via a directional antenna a communication signal comprising digital data modulated on a high frequency carrier 18 of frequency $f_1$. A common and central divider 80 connected via a receiver to directional antenna 82 divides the carrier frequency down to a low frequency $f_2$ of a signal $s_2$. The signal $s_2$ is transmitted via physical conductive link 84 to detonators 22.1 to 22.n in blast holes 28.1 to 28.n. This signal is utilized to energize the detonators and each detonator comprises an initiator comprising a charge storage device, the required logic circuitry, switch and fuse as hereinbefore described.

Figure 6:
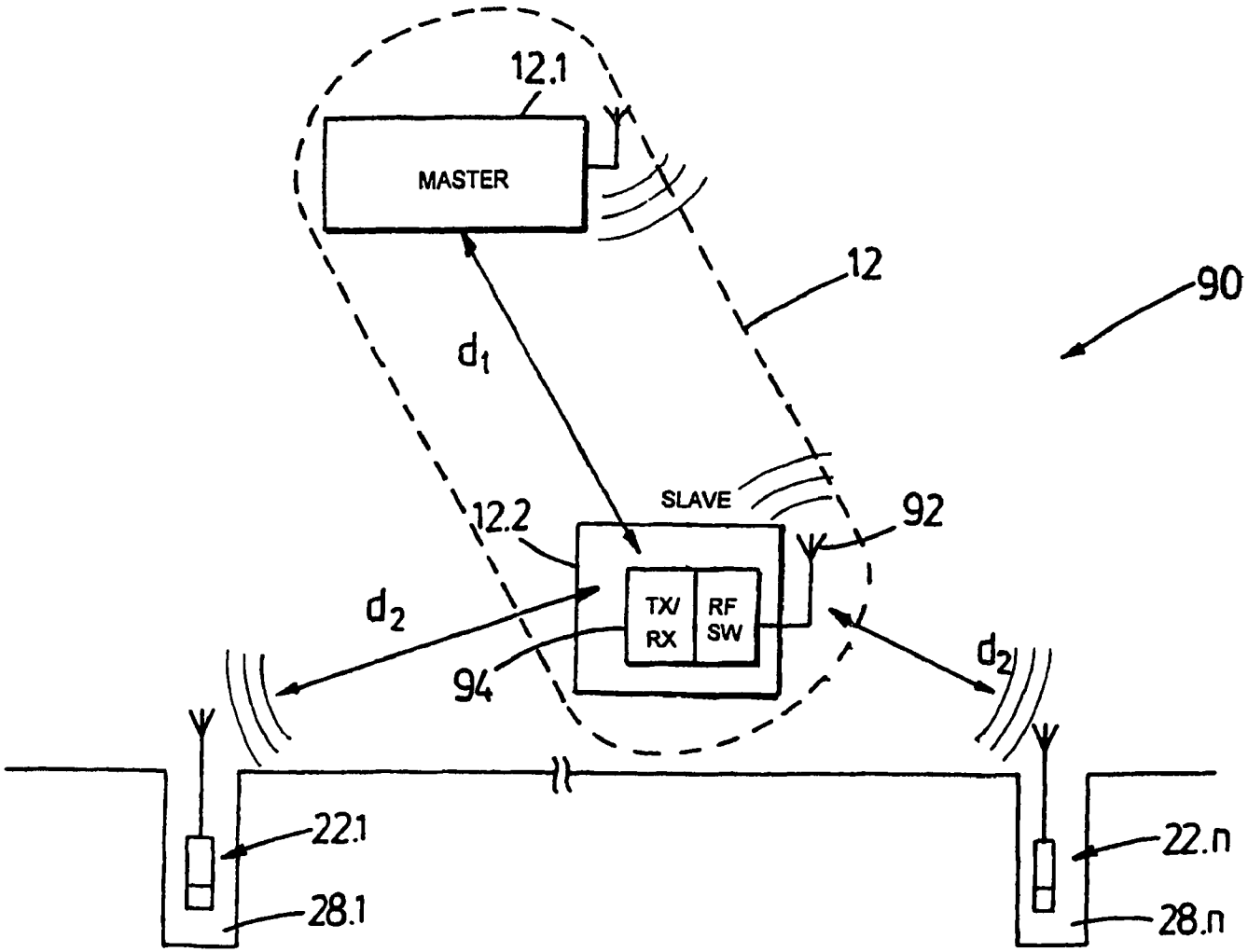
FIG. 6 is a basic block diagram of a fifth embodiment of the system according to the invention.

In FIG. 6, there is shown a fifth embodiment 90 of the system according to the invention. The blast controller 12 is of split configuration comprising a first or master part 12.1 and a second slave part or repeater part 12.2. The slave part 12.2 comprises a single antenna 92 for communications with the master part via wireless link 93 and for communications with respective detonators 22.1 to 22.n also via a respective wireless link 95.1 to 95.n. The slave part 12.2 hence comprises a transceiver 94 and single antenna 92 is connectable by an electronically controllable switch 96 to either a receiver of transceiver 94 cooperating with link 93 or a transmitter of the transceiver for broadcasting a first high frequency signal to detonators 28.1 to 28.n, as hereinbefore described.

In other embodiments the first signal 18 may not be utilized to energize the detonators and may comprise a carrier having the first high frequency and a data signal modulated on the carrier. The data signal is used to communicate with the detonators via the wireless link from a remote site 12. The data signal may hence comprise address data for an addressed detonator and delay time data for that detonator as hereinbefore described. In these embodiments the detonators may comprise respective on-board power supplies or batteries. Alternatively, charge storage devices in the form of capacitors on these detonators may be charged via a physical link such as link 84 shown in FIG. 5 from a common source of charge such as a battery. Each detonator may still comprise an RF receiver stage for receiving the programming data via the wireless link. Accordingly the data integrity required on the physical link would be reduced, since the physical link is utilized for energizing the detonators and not for data communications. The steps of charging the detonators, programming the detonators via the RF link and processing by the detonators of the delay time data may be performed sequentially.

In yet other embodiments the first signal 18 may be utilized both to energize the detonators as hereinbefore described and to communicate with the detonators as hereinbefore described. In these embodiments, the steps of charging the detonators and of programming the detonators may be performed substantially concurrently, or sequentially.

The invention claimed is:

1. A blasting system comprising a wireless link for broadcasting from a blast controller towards a plurality of detonators a first signal comprising a first frequency; and wherein each detonator comprises an electronic initiator comprising a high frequency part and a low frequency part comprising logic circuitry, the high frequency part comprising a radio frequency receiver stage, a charge storage device connected to the receiver stage and a divider circuit for dividing the first frequency down to generate a second signal that is a clock signal having a second frequency which is substantially lower than the first frequency, for driving the logic circuitry.

2. A system as claimed in claim 1 wherein the first signal comprises a carrier having the first frequency and a data signal modulated on the carrier for communicating with the detonators.

3. A system as claimed in claim 1 wherein each detonator respective charge storage device is charged by energy in the first signal.

4. A system as claimed in claim 1 wherein each detonator's respective charge storage device is charged from a source of charge connected to the respective charge storage device by a physical conductive link.

5. A system as claimed in claim 3 wherein the respective charge storage device comprises a capacitor.

6. A system as claimed in claim 1 wherein the first frequency falls in a range between 200 MH and 100 GHz.

7. A system as claimed in claim 6 wherein the first frequency is about 400 MHz.

8. A system as claimed in claim 1 wherein the first frequency is divided down five orders of magnitude.

9. A system as claimed in claim 1 further comprising a plurality of detonators to which the divider circuit of at least one detonator is common and wherein the divider circuit of the at least one detonator is connected to a receiver forming part of the wireless link and to said plurality of common divider circuit detonators by a physical conductive link.

10. A system as claimed in claim 1 wherein the low frequency part comprises a phase-locked loop and local oscillator connected to an output of said respective divider circuit and providing the clock signal to the logic circuitry.

11. A system as claimed in claim 10 wherein an input of the logic circuitry is connected via a data line to an output of a level detection circuit in the high frequency part.

12. A system as claimed in claim 11 wherein the logic circuitry is programmable by a data modulating signal of the first signal, to operate a switch of the initiator to cause charge on the charge storage device to be dumped into a fuse of the detonator.

13. A system as claimed in claim 1 wherein the low frequency and high frequency parts of the initiator are integrated on a single chip.

14. A system as claimed in claim 1 wherein the high frequency part and low frequency part are split and wherein an output of the high frequency part is connected by a physical conductive link to an input of the low frequency part.

15. A system as claimed in claim 1 wherein the wireless link is provided between a remote blast controller comprising an RF transmitter and an antenna located in close proximity to the blast controller on the one hand and the plurality of detonators on the other hand.

16. A system as claimed in claim 1 wherein the wireless link is provided between said plurality of detonators and an RF transmitter located in close proximity to the detonators.

17. A system as claimed in claim 16 wherein the RF transmitter is connected to a blast controller by a physical conductive link.

18. A system as claimed in claim 16 wherein a second wireless link is provided between the RF transmitter and a remote blast controller.

* * * * *